United States Patent [19]

Wiklund

[11] Patent Number: 4,833,844

[45] Date of Patent: May 30, 1989

[54] ROOF CONSTRUCTION

[76] Inventor: Per Wiklund, 58 A Kungsgatan, S-961 36, Sweden

[21] Appl. No.: 106,034

[22] Filed: Oct. 8, 1987

Related U.S. Application Data

[63] Continuation of Ser. No. 817,847, filed as PCT SE85/00139 on Mar. 28, 1985, published as WO85/04442 on Oct. 10, 1985, abandoned.

[30] Foreign Application Priority Data

Mar. 29, 1984 [SE] Sweden ..... 8401745

[51] Int. Cl.[4] ..... E04D 1/00; E04D 3/00

[52] U.S. Cl. ..... 52/90; 52/533; 52/551

[58] Field of Search ..... 52/90, 95, 277, 278, 52/309.9, 407, 460–462, 481, 489, 518–521, 543, 544, 553, 554, 560, 588, 781, 533, 534

[56] References Cited

U.S. PATENT DOCUMENTS

| | | | |
|---|---|---|---|
| 464,694 | 12/1891 | Kinnear | 52/521 |
| 1,144,725 | 6/1915 | Probert | 52/534 |
| 1,848,272 | 3/1932 | Powell | 52/407 |
| 2,164,138 | 6/1939 | London | 52/407 |
| 3,318,055 | 5/1967 | Piana | 52/90 |
| 4,155,206 | 5/1979 | Player | 52/200 |
| 4,375,848 | 3/1983 | Simpson et al. | 206/321 |
| 4,423,581 | 1/1984 | Miller | 52/462 X |
| 4,445,305 | 5/1984 | Orie, Sr. | 52/309.9 |
| 4,580,373 | 4/1986 | Bastiansen | 52/94 |

FOREIGN PATENT DOCUMENTS

| | | | |
|---|---|---|---|
| 168751 | 3/1906 | Fed. Rep. of Germany | 52/462 |
| 2162193 | 6/1973 | Fed. Rep. of Germany . | |
| 1329411 | 12/1963 | France . | |
| 172451 | 8/1960 | Sweden . | |
| 586333 | 3/1977 | Switzerland . | |
| 2026584A | 2/1980 | United Kingdom . | |

*Primary Examiner*—David A. Scherbel
*Assistant Examiner*—Lan Mai
*Attorney, Agent, or Firm*—Cushman, Darby & Cushman

[57] ABSTRACT

This invention relates to a roof construction, preferably intended to be arranged on a roof of a slight fall and comprising a plurality of supporting plate profiles (1:1') which are put on crossbars (6) or the like, said plate profiles (1:1') being placed in a certain spaced relationship.

At roofs having a slight fall, so-called plane roofs, it has so far been impossible in principle to use outer roof covering, as inleakage of water has been a great problem.

The invention is characterized in that channeled plates (8) are laid on the supporting plate profiles (1:1') and that a condensate bar in the form of a disc (15) is arranged under each plate (8) at some distance from this, the disc (15) connecting with the plate profiles (1:1').

6 Claims, 2 Drawing Sheets

ROOF CONSTRUCTION

This is a continuation of application Ser. No. 817,847, filed as PCT SE85/00139 on Mar. 28, 1985, published as WO85/04442 on Oct. 10, 1985, now abandoned.

This invention relates to a roof construction, preferably intended to be arranged on a roof of a slight fall, comprising a plurality of supporting plate profiles extending in the direction of the roof fall and put up on cross-bars or the like, said plate profiles being placed in a certain spaced relationship.

At roofs sloping only a few degrees, so-called plane roofs, the outer roof covering often consists of so-called weatherproof board as it has so far not been possible to use any other type of outer roof covering, e.g. plate, brick, due to the tendency of water to leak in as a consequence of the slight roof fall.

Moreover, plate roofs have been unsuitable due to formation of condensate. It is true that there are special compounds which are applied to the underside of the plate and bind the condensing water. However, this water must be given a possibility of evaporating, which has not always been the case due to lacking ventilation.

There is a continuous need of reconditioning the above-mentioned felt roofs, as the used so-called weatherproof board has a life of about 10–15 years. So far the only alternatives at renewal of such roofs with maintained fall have been either to tar the felt or lay new felt on top of the old one. However, only a relatively short life of the reconditioned roof will be obtained in this way. For this reason quite a new superstructure with a greater roof fall has also been made on the roof in certain cases and in doing this it has been possible to use e.g. plate or brick as outer roof covering. However, the last-mentioned method is relative expensive as quite a new superstructure must be made.

It is the object of this invention to provide a roof construction with plate as outer roof covering, which can be applied to so-called plane roofs without risking negative consequences at a possible inleakage of water.

This object of the invention is realized by means of a roof construction which has been given the characteristic features set forth in the annexed claims. An illustrative example of the invention will be described below with reference to the enclosed drawing, in which a perspective view of part of a roof construction according to the invention is shown schematically.

Figure 1:
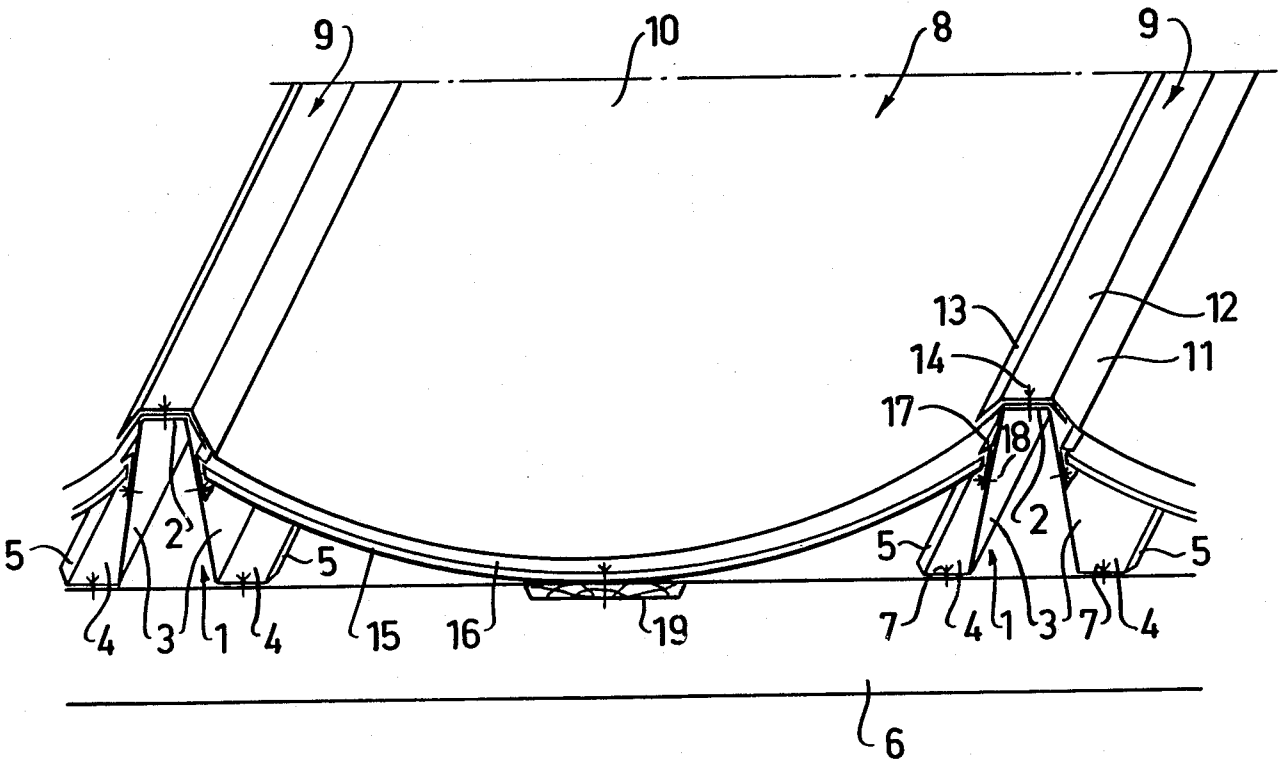
FIG. 1 is a fragmentary perspective view schematically showing a first embodiment of a roof construction according to the present invention.

The roof construction shown in FIG. 1 comprises supporting plate profiles 1, which have an upper flange 2, two mantles or sides 3 extending outwards and downwardly from this flange and at their lower ends passing on to outwardly directed lower flanges 4 having an upwardly bent free edge 5.

These plate profiles 1 are put up on supporting members 6 e.g. in the form of crossbars, light elements or the like, which extend transversely of the longitudinal direction of the plate profiles 1.

The plate profiles 1 are anchored in the supporting members 6 via the lower flanges 4 by means of attachment 7, which may consist of e.g. screws or nails.

The suitable centre/centre distance between the supporting members 6 is decided by the span that the plate profiles 1 can bridge, which is in turn dependent on the height, stiffening and plate thickness of the mantles 3.

The outer roof covering consists of channeled roofing sheets 8 which at their longitudinal lateral edges arc provided with edge portions 9 overlapping each other at adjacent plates 8.

The edge portions 9 have a connecting part 11 which preferably is plane and upwardly bent from the channeled portion 10.

A means of attachment 12 extending parallely to the main plane of the roof is connected to the connecting member 11, the edge portion 9 terminating in an edge part 13 downwardly bent relative to the means of attachment 12.

As is apparent from the Figure the means of attachment 12 is attached to the upper flange 2 of the plate profile 1, this attaching being effected by suitable attaching means 14, e.g. plate screws.

As two edge portions 9 overlap each other above the plate profile 1 the attaching means 14 pass through two means of attachment 12 and also the upper flange 2 of the plate profile 1. Under the roofing plate 8 a condensate trap is arranged in the form of a disc 15, preferably a hard fiberboard (MASONITE®). As is apparent from the Figure the disc 15 is arranged in a certain spaced relationship from the roofing plate 8, an air gap 16 being formed between the plate 8 and the channel shaped member 15.

Attachment of the longitudinal edges of the disc 15 to the mantle 3 of the plate profile is carried out by means of hook-shaped elements 17, which are adapted to the mantles 3 through fastening means 18. It can be said that the disc 15 is clamped between the plate profiles 1, the distance between the elements 17 at opposed longitudinal edges of a channel shaped member 15 being less than the width of the disc 15 in unactuated state. By a suitable adaptation of the vertical placement of the elements 17 on the mantles 3 and the distance between the plate profiles 1 the channel shaped member 15 will be given a downwardly bulged form which substantially agrees with the downward bulge of the roofing plate 8, the disc 15 and the channeled portion 10 of the plate 8 being substantially parallel.

As is apparent from the Figure a board 19 is arranged in the region of its lowermost point, which board in the illustrative example shown is recessed in the supporting member 6. The board 19 thus extends parallely to the plate profiles 1.

The purpose of the board 19 is to serve as anchoring member of the centre portion of the channel shaped member 15.

The air gap 16 has the effect that the plate 8 becomes ventilated on its underside, which is extraordinarily advantageous when it is about taking charge of the possible condensation water formed on the underside of the plate 8.

If condensate is formed to such an extent that venting in the air gap is insufficient to eliminate the condensation water such water possibly falling down from the plate will be collected on the disc 15 and carried in the direction of the roof fall to an external or internal surface water sewer.

The build-up of the surface construction according to the invention ensures to an extraordinarily high degree that no inleakage of water takes place.

As already described above condensation water possibly dropping down from the roofing plate 8 is taken charge of by the disc 15. This disc 15 also takes charge of water leaking through the roofing plate 8 on account of some damage, e.g. holes or cracks in the plate 8.

If it should happen that water leaks down between the longitudinal edges of the disc 15 and the hook shaped element 17 or between this and the mantle 3 of the plate profile 1 this water is taken charge of by the channel 4 and is carried away to a gutter or the like.

As pointed out above the roof construction according to the invention is especially suitable for so-called plane roofs, i.e. with a roof fall of only a few degrees. Usually such roofs slope inwardly and are consequently provided with so-called interior sewers which are hidden inside the building.

By the channel form of the roofing plate 8 rain water will automatically find its way due to the influence of gravity towards the lowermost point of the channel, the risk of inleakage of water in the overlapping joints, e.g. by the capillary force, in principle being eliminated.

Thus, double folding in the joints is avoided and usual overlapping is sufficient.

Figure 2:
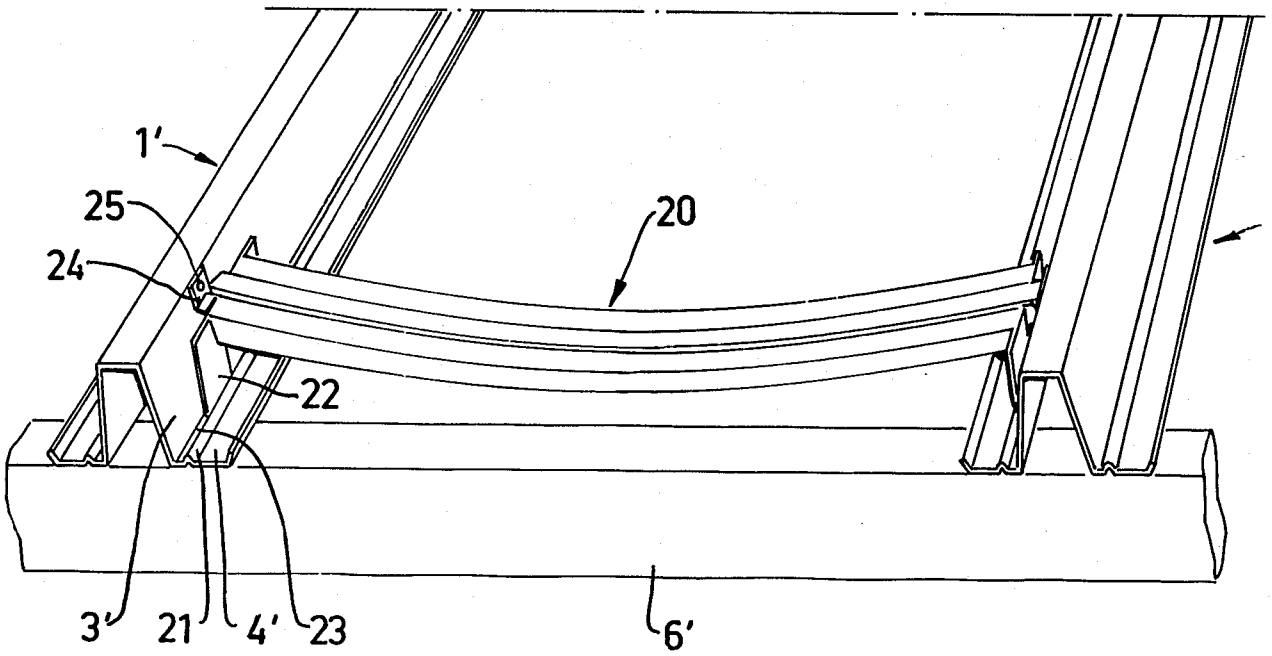
FIG. 2 is a fragmentary perspective view showing a second embodiment thereof.

As is apparent from FIG. 2 bent transversal profile members 20 can be arranged instead of the longitudinal board 19, which members support the board 15 between the crossbars 6'.

Thus, the profile element 20 is anchored with its ends to the plate profile 1', which are different from the plate profiles 1 according to FIG. 1 through the longitudinal grooves 21 arranged in the lower flanges 4'.

The anchorage of a profile element 20 to the plate profiles 1' is made in that downwardly extending tongues 22 of the profile element 20 are placed in the groove 23 formed between the mantles 3' of the plate profiles 1' and the groove 21. An upwardly directed tongue 24 of the profile element 20 is thereafter anchored, e.g. by means of a screw 25, in the mantle 3' of the profile 1'. In this way the ends of the profile element 20 are fixed to the plate profiles 1'.

Thus, with the roof construction of the present invention an extraordinarily tight roof covering is obtained and if water should still leak in, e.g. on account of damage, the leaking water is taken charge of and led to sewage, underlying parts of the roof construction being protected.

It is possible within the scope of the invention to replace the board 15 by a plate, which is applied in a way corresponding to the disc.

The invention can also be freely varied in other respects within the scope of the following claims.

I claim:

1. A roof construction for a roof having a slight pitch, comprising:

a plurality of generally parallel crossbars extending transversally of a direction of roof slope, said crossbars being spaced apart laterally from one another in said direction;

a plurality of generally parallel supporting plate profiles extending parallel to said direction of roof slope, said supporting plate profiles being spaced apart laterally from one another transversally of said direction;

each said profile having a central portion of generally inverted-channel shape and two laterally-opposite longitudinal edge portions each provided along a respective free edge thereof with an upturned margin, whereby each said edge portion forms, with the respective said central portion an upwardly-opening condensate drain channel;

said supporting plate profiles being supported upon and secured by securing means to said crossbars with said longitudinal edge portions being disposed adjacent said crossbars, said central portions extending upwardly above said crossbars between respective said longitudinal edge portions;

each said central portion including a top wall and two laterally-opposite sidewalls which extend downwards therefrom to join with respective ones of said longitudinal edge portions;

a plurality of roof plates each having two laterally-opposite edge portions, and an upwardly-opening channel-shaped main portion which extends between and slopes downwardly towards a medial location thereon, from said edge portions thereof;

each said roof plate having one edge portion thereof overlappingly supported on a respective top wall of a respective central portion of a respective said supporting plate profile, and a respectively opposite said edge portion thereof overlappingly supported on a respective one edge portion of a laterally adjoining said one of said roof plates overlappingly supported upon a respective top wall of a respective central portion of a laterally adjoining respective said supporting plate profile, except at one edge of said roof, where, due to said one edge, no respective said laterally adjoining roof plate exists;

a plurality of upwardly-open, channel shaped condensate trap plates, each disposed under a respective said roof plate with spacing vertically therebetween, to provide a respective air gap, and extending laterally between a respective two of said supporting plate profiles; and means connecting said condensate trap plates to respective said supporting plate profiles above the respective said condensate drain channels.

2. The roof construction of claim 1, wherein:

said connecting means comprise opposed hook-shaped elements mounted on facing ones of said sidewalls of respective twos of said supporting plate profiles; and said condensate trap plates have laterally opposite edges mounted to respective ones of said hook-shaped elements.

3. The roof construction of claim 2, wherein:

said hook-shaped elements on facing ones of said sidewalls comprise channels which open towards one another and said condensate trap plates are held in forcibly downwardly bowed conditions by being bowed and having said laterally opposite edges received in said channels which open towards one another, spacing between respective sidewalls being such as to maintain said bowed conditions.

4. The roof construction of claim 2, wherein:

each said crossbar has an upper edge which, centrally between each respective two of supporting plate profiles, has an upwardly-opening recess;

said roof construction further including:

a plurality of anchoring boards, each said anchoring board extending generally parallel to and centrally between a respective two of said supporting plate profiles, each said anchoring board being supported on said crossbars in respective of said notches; and means securing respective anchoring boards onto respective said anchoring boards, so that said anchoring boards are disposed upon and anchored to said crossbars by said anchoring boards.

5. The roof construction of claim 4, wherein:

said laterally opposite sidewalls of each said central portion diverge downwardly.

6. The roof construction of claim 1, wherein:

said connecting means comprise a plurality of upwardly concave elements extending laterally between respective twos of said supporting plate profiles, each said element having two opposite ends each provided with a respective downwardly-extending tongue which stands on a respective said longitudinal edge portion of a respective said supporting plate profile adjacent a respective said central portion of the respective said supporting plate profile, each trap plate being cradled upon at least one respective said element.

* * * * *